United States Patent [19]

Erb

[11] 4,158,376

[45] Jun. 19, 1979

[54] FOLDABLE CONTAINER

[76] Inventor: René Erb, 4 rue du Dr Schneider, 67320 Drulingen, France

[21] Appl. No.: 869,839

[22] Filed: Jan. 16, 1978

[30] Foreign Application Priority Data

Jan. 20, 1977 [FR] France ..... 77 01604

[51] Int. Cl.[2] ..... B65D 1/00

[52] U.S. Cl. ..... 150/0.5; 229/DIG. 4

[58] Field of Search ..... 150/0.5, 1; 222/107; 229/DIG. 4

[56] References Cited

U.S. PATENT DOCUMENTS

| | | | |
|---|---|---|---|
| 2,950,029 | 8/1960 | Winstead | 150/0.5 X |
| 3,081,002 | 3/1963 | Tauschinski | 150/0.5 X |
| 3,087,491 | 4/1963 | Gewecke | 150/0.5 X |
| 3,319,684 | 5/1967 | Calhoun | 150/1 X |
| 3,354,924 | 11/1967 | Birrell | 150/0.5 |
| 3,595,441 | 7/1971 | Grosjean | 150/0.5 X |
| 4,056,138 | 11/1977 | Fagniart | 150/0.5 |

*Primary Examiner*—Donald F. Norton

*Attorney, Agent, or Firm*—Merchant, Gould, Smith, Edell, Welter & Schmidt

[57] ABSTRACT

A foldable container made of flexible material and adapted to be introduced into a foldable semi-rigid support and to contain liquid, powderous or granular products or the like, has the shape of a rectangular parallelepiped having two parallel square or rectangular bases one of which comprises at least one filling or evacuating aperture. Two mutually opposed lateral walls of said container are provided each with a rib constituted by a bead extending longitudinally over at least a portion of the height of said lateral walls and allowing said lateral walls to be folded about said ribs and the remaining two lateral surfaces to be brought at least partially into contact with each other.

16 Claims, 3 Drawing Figures

FOLDABLE CONTAINER

The present invention is related to a foldable container made of flexible material, adapted to be introduced into a foldable semi-rigid support, and adapted to contain powderous, granular or similar products.

Known containers of this kind have a generally cubic shape defined by two identical shells which are assembled to each other by welding in a diagonal plane. Generally these known containers are folded about the weld, or welded joint, produced when assembling the two pre-manufactured shells. The manufacture of these known containers is comparatively expensive due to the fact that a welding operation is required. Furthermore, these known containers, when in the folded, or collapsed, state have the form of a comparatively bulky pyramid.

The present invention is aimed at eliminating the drawbacks of the known containers of the above-described kind.

Consequently the present invention provides a container having a rectangular parallelepipedic shape which can easily be folded in a medium plane and be collapsed to constitute a substantially planar structure, in such a manner that a plurality of such structures may easily be stacked. The container according to the invention can be manufactured by an extrusion-blowing process which is comparatively inexpensive and enables the production of reinforcing ribs for facilitating the folding of the container.

It is an object of the invention to provide a container made of flexible material, of the kind described herein above, which has the shape of a rectangular parallelepiped having two parallel square or rectangular bases one of which is provided with at least one filling and evacuating aperture, two mutually opposed lateral walls of said container comprising each a rib constituted by a bead extending longitudinally over at least a portion of the height of said lateral walls, the arrangement being such that said two lateral walls can be folded about said ribs whereby the remaining two lateral walls of the container are brought into contact with each other.

The invention will be described in a more detailed manner herein below with reference to the appended Figures which are given by way of illustration, but not of limitation.

Figure 1:
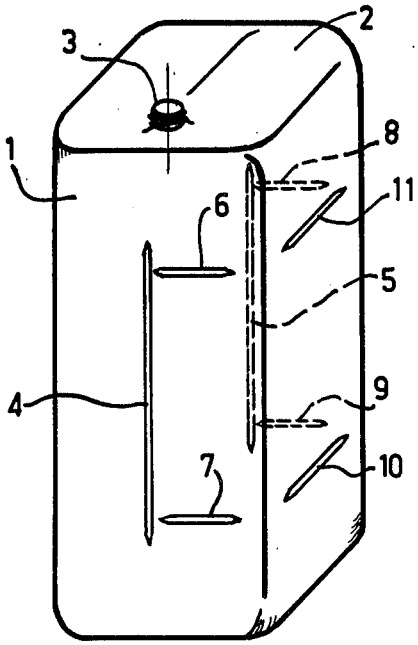
FIG. 1 shows, in perspective, a container according to the invention.

As shown in FIG. 1, the container according to the invention is constituted by a structure in the form of a pocket 1, preferably made of polyethylene and produced by an extrusion-blowing process, said pocket 1 having the shape of a rectangular parallelepiped. The upper base 2 of the parallelepipedic container is provided with a filling or evacuating spout 3 which may be fixed to the container by gluing or welding, or which may be produced in the form of an element integral with pocket 1. The walls of pocket 1 are flexible and the container constituted by said walls is adapted to be introduced into a foldable semi-rigid support, such as a cardboard box, prior to filling the container.

Figure 2:
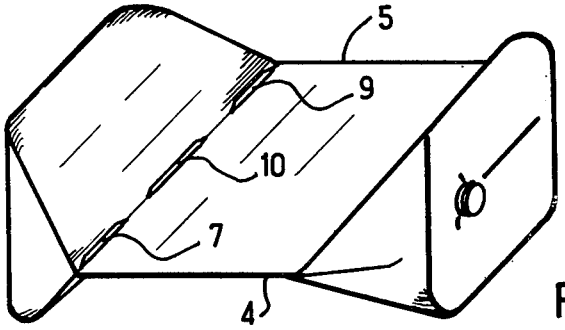
FIG. 2 shows the container of FIG. 1 in a partially folded, or collapsed, condition.

With a view to facilitating the folding of the container, in the manner illustrated in FIG. 2, pocket 1 is provided on two parallel lateral opposed walls with longitudinal ribs 4 and 5 located in a median plane of the container. The length of these ribs is preferably equal to the height of the container less, at each end of each rib, half of the width of the corresponding lateral wall. It is possible, of course to provide ribs extending over the entire length of the lateral walls, and even through the bases or end walls, such as 2, of the container so as to end in the vicinity of the central filling and evacuating orifice of the upper base, which is associated with an inviolable spout. The above-mentioned lateral walls also comprise transverse ribs 6, 7, 8 and 9 defining two transverse planes in which are also located ribs 10 and 11 arranged parallel to each other on one of the remaining lateral walls which is located between the two first-mentioned opposed lateral walls.

Figure 3:
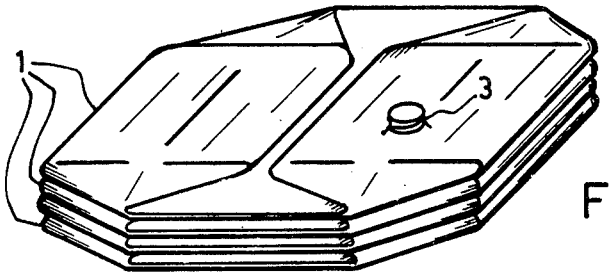
FIG. 3 shows a plurality of containers of the kind illustrated in FIGS. 1 and 2, these containers being in their entirely folded or collapsed condition and stacked one upon the other.

As shown in FIG. 2, the transverse ribs 7, 9 and 10 are in line with each other when container 1 is folded around the longitudinal ribs 4 and 5. Similarly ribs 6, 11 and 8 (not shown) are in line with each other. Due to this arrangement, it is possible to fold over easily the two bases, or base walls, i.e. the upper and the lower base walls of the container in such a manner that they engage the lateral walls each one of which has already been folded, as shown in FIG. 3.

The particular shape of container 1 such as described herein above and the manner of folding said container, which folding is facilitated by the provision of the described longitudinal and transverse ribs, allows to fold a plurality of containers in such a way that each container requires, in the folded or collapsed state, only a minimum of storage volume, whereby it is possible to stack and store a great number of such containers in a minimum storage space.

Another advantage of the container according to the invention resides in the fact that the pocket 1 is made of polyethylene and obtained by an extrusion-blowing process which eliminates any subsequent operation such as assembling two identical half-shells, which was current practice up to now when manufacturing containers of the above-described known type. Consequently the novel container can be produced at a considerably reduced cost, and furthermore the novel container exhibits a considerably increased rupture strength and thus a considerably increased safety in practical use, as compared to the conventional containers of the type in question.

The invention is not limited to the embodiments described herein before and shown in the Figures. Many variants and modifications may be envisaged by any person skilled in the art without departing from the spirit of the invention as defined in the appended claims.

What is claimed is:

1. A rectangular parallelepiped foldable container made of flexible material and adapted to be introduced into a foldable semi-rigid support and to contain a flowable product comprising two rectangular base walls generally parallel to one another, two rectangular first side walls generally parallel to each other and connected to said base walls, and two rectangular side walls generally parallel to each other and connected to said base walls and to said first side walls, each of said first and second side walls having an inner and an outer surface, one of said base walls having at least one aperture, each one of said first side walls having a folding rib extending longitudinally in the middle of an associated first side wall over at least a portion of the length thereof between said base walls, each first side wall being foldable along its longitudinal rib to fold each first side wall upon itself and to place the interior surfaces of said second side walls into contact with one another, each one of said first side walls further having two first transverse folding ribs generally perpendicular to said longitudinal ribs and located each at a given distance from a respective one of said base walls and extending toward one of said second side walls, said one of said second side walls being provided with two second transverse folding ribs located each at said given distance from a respective one of said base walls whereby each one of said second transverse folding ribs is in line with a corresponding pair of said first transverse folding ribs provided on said two first side walls.

2. A container in accordance with claim 1, wherein the length of said longitudinal ribs is at least substantially equal to the length of said side walls minus, at each end of each one of said ribs, half the width of an associated first side wall.

3. A container in accordance with claim 1 wherein said aperture is defined by a spout integral with one of said base walls.

4. A container in accordance with claim 1 wherein said container is made of a synthetic material.

5. A container in accordance with claim 4 wherein said container is made of a thermoplastic material.

6. A container in accordance with claim 5 wherein said container is made of polyethylene.

7. A container in accordance with claim 4 wherein said container is produced by an extrusion-blowing process.

8. A method of folding a container made of flexible material and comprising two parallel generally rectangular base walls, two generally rectangular first side walls parallel to each other and connected to said base walls, and two generally rectangular second side walls parallel to each other and connected to said base walls as well as to said first side walls, wherein each one of said first side walls has a folding rib extending longitudinally in the middle of an associated first side wall over at least a portion of the length thereof between said base walls, each one of said first side walls further having two first transverse folding ribs generally perpendicular to said longitudinal ribs and located at a given distance from a respective one of said base walls and extending toward one of said second side walls, said one of said second side walls being provided with two second transverse folding ribs located each at said given distance from a respective one of said base walls whereby each one of said second transverse folding ribs is in line with a corresponding pair of said first transverse folding ribs provided on said two first side walls, each of said first and second side walls having an inner and an outer surface, said method comprising the steps of folding said first side walls along said longitudinal folding ribs in such a manner that each one of said first side walls is folded upon itself and that said second side walls engage each other by their inner surface, and then folding each end portion of the container comprising a respective base wall about the transverse folding ribs located at said given distance from a respective one of said base walls.

9. A rectangular parallelepiped container made of flexible material foldable between an open and a collapsed position and adapted to be introduced into a foldable semi-rigid support and to contain a flowable product comprising two rectangular base walls generally parallel to one another in said open position, two rectangular first side walls generally parallel to each other in said open position and connected to said base walls, and two rectangular second side walls generally parallel to each other in said open position and connected to said base walls and to said first side walls, one of said base walls having at least one aperture, each one of said first side walls having a folding rib extending longitudinally in the middle of an associated first side wall over at least a portion of the length thereof between said base walls, each of said first and second side walls having an inner and an outer surface, a pair of assemblies formed between said two folding ribs, each assembly being formed by one of the said second side walls and a half of each first side wall adjacent thereto, said assemblies being foldable one upon the other such that the inner surfaces of the first and second side walls of one of the assemblies contacts the inner surfaces of the first and second side walls of the other assembly in said collapsed position, each of the base walls being foldable along a line passing through said assemblies and generally transverse to said folding ribs whereby each base wall is generally parallel to the said assemblies in said collapsed position.

10. A container in accordance with claim 9, wherein the length of said longitudinal ribs is at least substantially equal to the length of said side walls minus, at each end of each one of said ribs, half the width of an associated first side wall.

11. A container in accordance with claim 9 wherein said aperture is defined by a spout integral with one of said base walls.

12. A container in accordance with claim 9 wherein said container is made of a synthetic material.

13. A container in accordance with claim 12 wherein said container is made of a thermoplastic material.

14. A container in accordance with claim 13 wherein said container is made of polyethylene.

15. A container in accordance with claim 12 wherein said container is produced by an extrusion-blowing process.

16. A method of folding a rectangular parallelepiped container made of flexible material between an open and a collapsed position, said container being adapted to be introduced into a foldable semi-rigid support and to contain a flowable product and comprising two rectangular base walls generally parallel to one another in said open position, two rectangular first side walls generally parallel to each other in said open position and connected to said base walls, and two rectangular second side walls generally parallel to each other in said open position and connected to said base walls and to said first side walls, one of said base walls having at least one aperture, each one of said first side walls having a folding rib extending longitudinally in the middle of an associated first side wall over at least a portion of the length thereof between said base walls, each of said first and second side walls having an inner and an outer surface, a pair of assemblies formed between said two folding ribs, each assembly being formed by one of the said second side walls and a half of each first side wall adjacent thereto, said assemblies being foldable one upon the other such that the inner surfaces of the first and second side walls of one of the assemblies contacts the inner surfaces of the first and second side walls of the other assembly in said collapsed position, each of the base walls being foldable along a line passing through said assemblies and generally transverse to said folding ribs whereby each base wall is generally parallel to said assemblies in said collapsed position, said method comprising the steps of folding said first side walls along said longitudinal folding ribs in such a manner that each one of said first side walls is folded upon itself and that said second side walls engage each other by their inner surface, and then folding each end portion of the container comprising a respective base wall about a line passing through said first and second side walls and generally transverse to said longitudinal folding ribs so that each base wall extends generally parallel to said first and second side walls.

* * * * *